US005445380A

United States Patent [19]

Polsky

[11] Patent Number: 5,445,380

[45] Date of Patent: Aug. 29, 1995

[54] FOLDING PICTURE PUZZLE

[76] Inventor: Nathan Polsky, 8020 Muirhead Cir., Boynton Beach, Fla. 33437

[21] Appl. No.: 257,107

[22] Filed: Jun. 8, 1994

[51] Int. Cl.[6] ..... A63F 9/08

[52] U.S. Cl. ..... 273/155; 446/487

[58] Field of Search ..... 273/153 R, 155, 159; 446/487; 434/172, 176; 40/446, 529

[56] References Cited

U.S. PATENT DOCUMENTS

| | | | |
|---|---|---|---|
| 510,216 | 12/1893 | Waibel . | |
| 566,854 | 9/1896 | Frank . | |
| 847,545 | 3/1907 | Braine | 273/155 |
| 1,944,696 | 1/1934 | Reichl . | |
| 2,092,583 | 8/1937 | Michael . | |
| 2,327,875 | 8/1943 | Edborg . | |
| 2,327,876 | 8/1943 | Edborg . | |
| 2,655,382 | 10/1953 | Belsky . | |
| 3,892,411 | 7/1975 | High | 273/155 |
| 4,170,355 | 10/1979 | Finkin | 273/155 |
| 4,465,467 | 8/1984 | Exelby | 434/172 |
| 4,685,680 | 8/1987 | Rubik . | |

*Primary Examiner*—Vincent Millin
*Assistant Examiner*—William M. Pierce
*Attorney, Agent, or Firm*—Browdy and Neimark

[57] ABSTRACT

The invention relates to a rectangular multi-picture folding puzzle that serves for the amusement of its user. The folding puzzle is composed of a flat base sheet material with a patchwork of partial picture images printed on at least one playing side and additionally subdivided into at least sixteen equal and uniform squares by a combination of score lines and cuts which enable the player to fold square segments into proper juxtaposition to assemble a complete individual picture image.

25 Claims, 12 Drawing Sheets

FOLDING PICTURE PUZZLE

BACKGROUND OF THE INVENTION

1. Field of the Invention

The invention relates to an amusement and education device in the form of a folding picture puzzle, and more particularly to a multi-picture folding puzzle in a rectangular format.

2. Description of Related Art

Folding puzzles made of a flat sheet material provided with indicia or fragmentary images and which form a complete picture of a scene or well-known object when properly folded are known in the art.

Edborg, U.S. Pat. No. 2,327,875, discloses a folding picture puzzle on a flexible rectangular sheet with partial pictures of animals printed on triangular segments formed by the intersection of horizontal, vertical and diagonal fold lines. When combined with diagonal cuts that originate at an edge of the flexible rectangular sheet, the fold lines allow for proper folding into a complete picture by juxtaposing four triangular segments. The disclosed folding picture puzzle has sixteen triangular segments per side that can be folded in any of a multiple of combinations to form either of only two complete pictures.

A second concurrently issued patent to Edborg, U.S. Pat. No. 2,327,876, also discloses a folding picture puzzle, but in this case as a central hexagon made up of a series of triangles meeting at a point at their bases and projecting outward away from the hexagon to form a six-pointed star. Folding along the fold lines together with an incision made along a single fold line are used for juxtaposing triangular segments having partial pictures printed thereon to form a single complete picture. There appear to be multiple solutions to forming a complete picture by the juxtaposition of triangular segments.

The folding picture puzzle disclosed by Belsky, U.S. Pat. No. 2,655,382, is flat and comprised of a series of multidirectional scoring lines that subdivide fragmentary pieces of a picture so that a single complete picture can be recreated when the puzzle is properly folded. Only one side can form a complete picture, the opposite side being provided with a means for tucking folds in such a manner as to lock in the solution to the puzzle.

U.S. Pat. No. 566,854, issued in 1896 to Frank, also discloses a type of folding picture puzzle. The puzzle is described as a wheel with twelve radial die cuts originating from the edge of the wheel and terminating halfway to the center of the wheel, dividing the circumference of the wheel into twelve equal sections that can be folded towards the center. Parts of images are printed on the reverse side of the wheel such that when multiple sections are folded over on top of one another, a complete image or picture is formed.

SUMMARY OF THE INVENTION

The present invention relates to a folding picture puzzle that serves the amusement of its user and is educational for a child. The folding picture puzzle is composed of a flat rectangular sheet with at least one and preferably two playing sides provided with indicia and divided into square segments of uniform size by hinge or score lines and die cuts, but still held together as a single contiguous piece. As indicia, partial pictures or images are provided in a fragmentary arrangement on these square segments on both sides of the sheet. Upon proper folding of the sheet along its hinge lines in ways permitted by the die cuts, a complete picture or image is formed by the juxtaposition of certain square segments. The puzzle may be folded in other ways to juxtapose different combinations of square segments and form other separate pictures or images on either side of the folding puzzle sheet, so that each puzzle is capable of forming several different pictures.

It is therefore an object of the present invention to provide an improved folding picture puzzle that is held together as a single entity with no separate parts to be lost or separated, and which is capable of being folded into a variety of different pictures or images.

Another object of the present invention is to provide a folding puzzle embodying square segments containing partial pictures or images capable of forming a complete picture on either playing side of the folding picture puzzle.

A further object of the present invention is to provide multiple pictures or images to be solved separately by proper juxtaposition of different combinations of square segments.

Yet another object of the present invention is to provide for different puzzle configurations that vary in level of difficulty.

These and other objects and the nature and advantages of the present invention will be more apparent from the following detailed written description of certain preferred embodiments taken in conjunction with the drawing, wherein:

DETAILED DESCRIPTION OF EMBODIMENTS

Figure 1A:
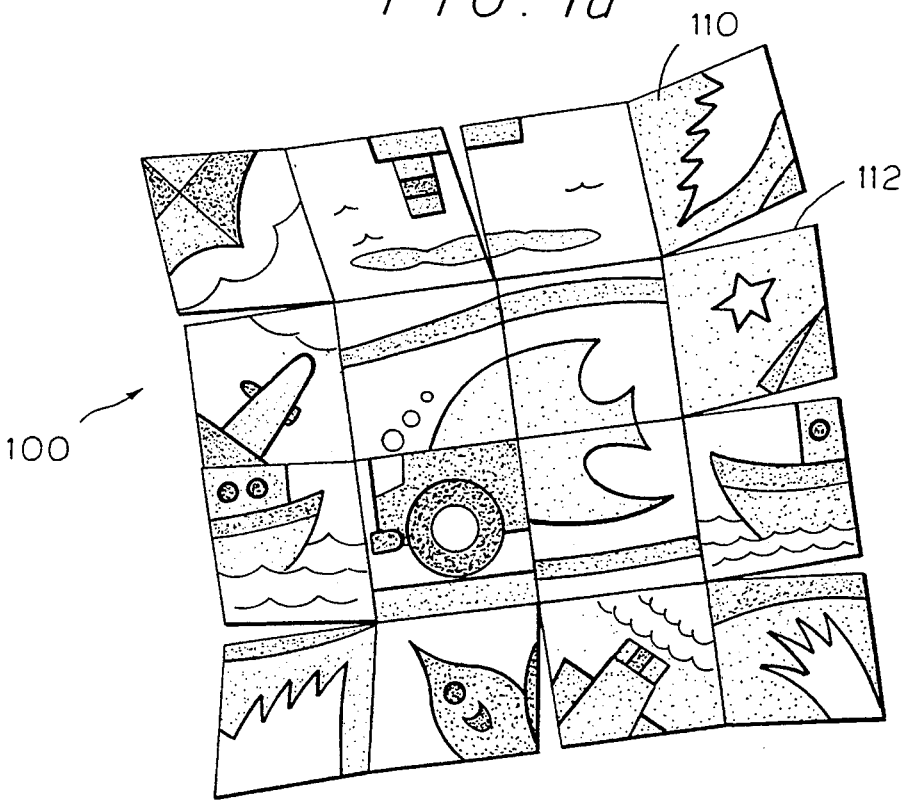
FIG. 1*a* shows one face/side of a first embodiment of a folding picture puzzle, according to the present invention.
Figure 1B:
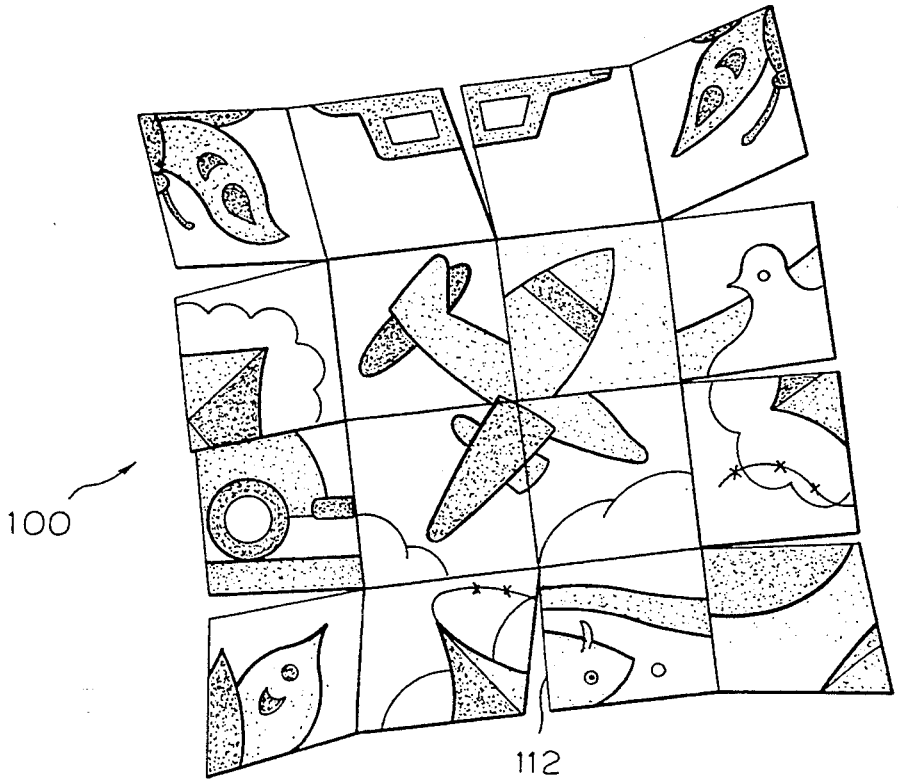
FIG. 1*b* shows the opposite face/side of the first embodiment of the folding picture puzzle.

The present invention relates to a multi-picture folding puzzle in a rectangular format with two playing sides or faces on a single base sheet, both sides preferably having printed with a patchwork of partial pictures or images as shown in FIG. 1*a* (one playing side of a sixteen square puzzle) and FIG. 1*b* (opposite playing side of same puzzle). Alternatively, only one side of the base sheet may be provided with a patchwork of partial pictures or images. The base sheet is divided into at least twelve equal and uniform squares by a combination of horizontally or vertically oriented hinge or score lines and cuts. The puzzle and all its component square segments is a single contiguous entity that has the advantage of not having any separated parts that may be lost or misplaced.

All the equal and uniform square puzzle segments are held together as a contiguous piece by the pattern of hinge lines. Cuts and hinge lines form the boundaries between adjacent squares with hinge lines joining at least one side of each square with an adjacent square and with cuts completely separating two adjacent squares. It is preferred that at least some of the hinge lines permit rotation or folding of the adjacent squares in both directions to allow for bidirectional folding such that partial picture segments may be part of a larger assembled picture image on either side of the puzzle sheet. Furthermore, cuts completely separate adjacent squares and facilitates the bidirectional folding of squares along hinged score lines so that when properly juxtaposed two or more squares having partial pictures or images on them can cooperate to form a complete assembled image on one playing side.

The base sheet is preferably paper or paperboard in which case the hinge lines are score lines, with the patchwork of partial images printed thereon. A clear polyester film, preferably made of polyethylene terephthalate (e.g., Mylar TM), may be added on each side of the base sheet to sandwich the base sheet into a laminate that confers strength to the puzzle as well as reinforcement of the score lines. Such a laminated puzzle board is better able to withstand the handling and the stress of constant folding and refolding of the puzzle during play. The puzzle board may alternatively be formed of other materials, such as plastic coated or impregnated paper, or Tyvek TM, or even entirely of plastic, e.g., a plastic puzzle board may be made from an opaque or transparent vinyl or another clear plastic sheet material with the patchwork of partial images printed thereon.

In the preferred embodiment, the folding picture puzzle has partial pictures or images on some, if not all, square segments on both playing sides. By appropriate folding, multiple pictures or images can be individually formed on both sides of the puzzle, each picture image being formed by separately solving the correct folding of square segments to bring all the correct partial picture image segments necessary to form a complete assembled picture image together in proper juxtaposition and alignment. The complete assembled picture images are all in a rectangular picture format and preferably each side is provided with additional indicia for indicating the rightside up orientation of the playing side such as the words "side 1" or "side 2". After solving one picture puzzle solution, the puzzle can be returned to its fully opened position to start the solution for assembling another picture image. Each multi-picture puzzle provides at least six picture images on both playing sides that can be solved sequentially in any order. The total number of separate pictures can be between 6 and 30. When play ceases, the puzzle can be folded flat into a sufficiently small size for storage.

In another embodiment, the folding picture puzzle has partial pictures or images on some, if not all, square segments on only one playing side and multiple pictures or images can also be individually formed on at least one puzzle playing side. Each multi-picture puzzle provides at least three complete picture images on at least one playing side with the total number of separate pictures being between 3 and 15.

The folding puzzles are designed to vary in the level of difficulty ranging from the simplest sixteen square puzzles to the more complex 64 square puzzles having a total of 30 separate images on both playing sides. By providing this range in the level of difficulty for solving the puzzles, players from different age groups will be suitably challenged according to their abilities.

The location of the cuts, which are desirably die cuts when the puzzle board is formed of paperboard or the like, can be designed to allow for extensive folding possibilities of the square puzzle segments. In other words, positioning of each square segment is governed by the pattern of cuts. At least some of the cuts start at one outer edge of the puzzle and extends towards the opposite edge by a distance measured as a discrete (integer) multiple of square segment length. Optionally, other cuts, which do not originate from an outer edge of the puzzle, are joined instead to a cut or to a series of cuts where one cut originates at an outer puzzle edge. Folding along a hinge or score line in combination with a cut spanning more than one square segment in length determines the placement of a square(s) on one playing side over adjacent contiguous square(s) on the opposite playing side. Cuts that span several squares or more, however, can permit the placement of a square several square lengths away. This manner of moving past intervening contiguous squares to a location several square segments away increases the difficulty of a puzzle solution. Thus, a square far removed from the picture assembly area can be translocated and thereby positioned where it can be assembled with other squares to form a complete and assembled picture. These cuts offer an important design feature that can be used to increase the complexity of the puzzle solution.

Figure 2A:
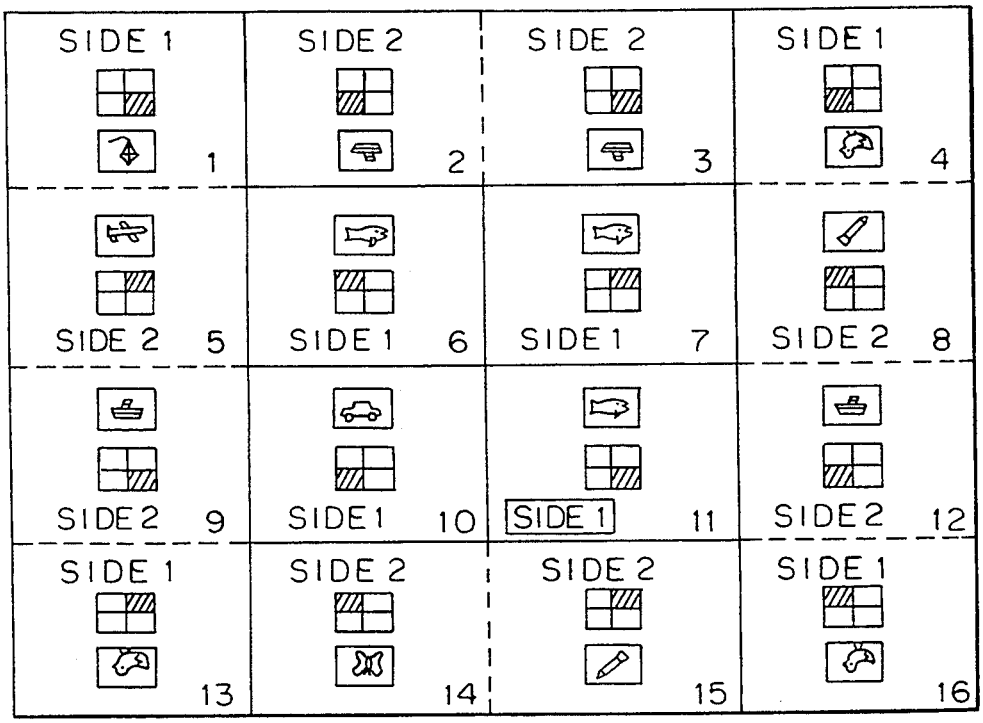
FIG. 2*a* shows one face/side of the first embodiment of the folding picture puzzle in schematic/explanatory form.
Figure 2B:
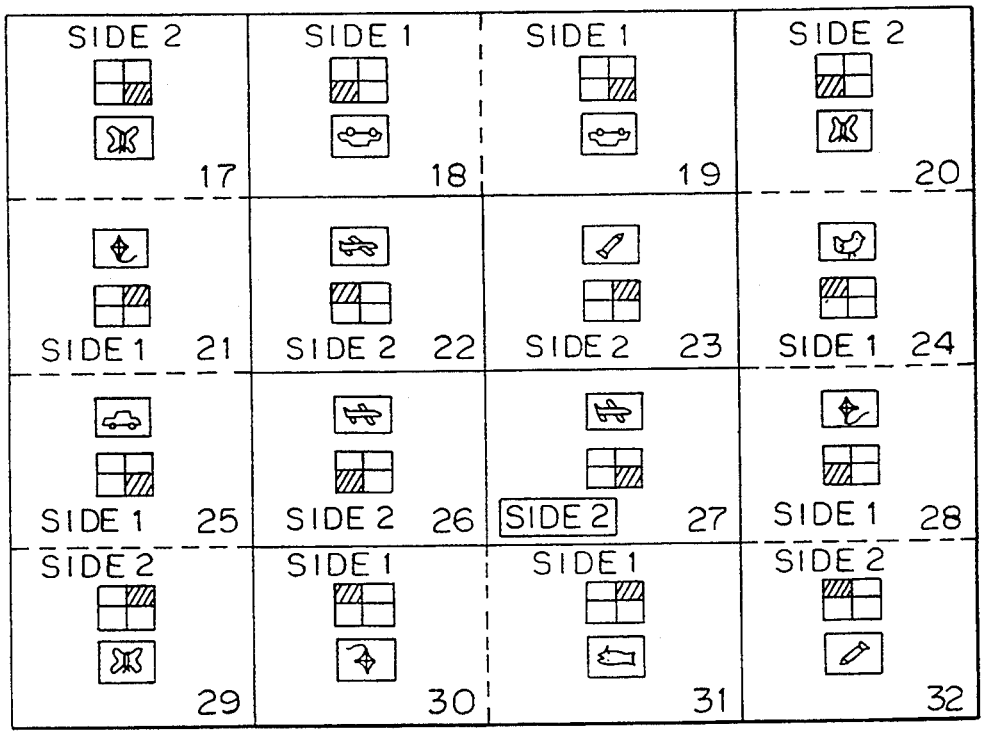
FIG. 2*b* shows the opposite face/side of the first embodiment of the folding picture puzzle in schematic-/explanatory form.

In a simple embodiment 100 of the invention, FIG. 2*a* and 2*b* show a schematic representation of both sides of the puzzle shown in FIG. 1*a* and 1*b*, respectively, and illustrate the features of a sixteen square puzzle in a four square by four square format having eight picture images on both playing sides. Comparing the actual illustration of the puzzle 100 in FIG. 1*a* and 1*b* with its schematic or representational form in FIG. 2*a* and 2*b*, it will be understood that solid lines between adjacent square segments in FIGS. 2*a* and 2*b* represent score or hinge lines 110 and that dashed lines between adjacent square segments represent cuts 112. The sixteen square puzzle can be described as forming four vertical columns and four horizontal rows by the combination of vertically and horizontally oriented score or hinge lines and cuts so as to define from left to right, first, second, third and fourth columns and from top to bottom, first, second, third and fourth rows, the square segments being numbered 1–16 and 17–32 in the schematic drawing.

When viewed from one side of the puzzle as illustrated in FIGS. 1*a* and 2*a*, cuts completely separate adjacent squares and are disposed as follows: between the second and third columns in the first and fourth rows; between the first and second rows in the first and fourth columns; between the second and third rows in the first and fourth columns; and between the third and fourth rows in the first and fourth columns.

Each square segment is represented in the schematic drawing by a boxed picture symbol 114 designating the assembled picture to which the square segment belongs and is also represented by whether that particular picture is assembled on side 1 or side 2 of the puzzle. In addition, each square segment is also represented by a four quadrant picture arrangement diagram 116 of the assembled picture that schematically designates which quadrant of the complete assembled picture the square segment belongs. The orientation of the boxed picture symbol determines the orientation for viewing the picture arrangement diagram. Thus, the picture arrangement diagram is always to be viewed in the orientation where it is positioned below a rightside up boxed picture symbol.

In this particular embodiment, each picture is assembled from four square segments to form its four quadrants in the center four square area (stage) of the puzzle. However, folding picture puzzles of this invention are not limited to being formed from four square segments in a four quadrant arrangement. Assembled pictures may .be formed in a two square segment, six square segment, eight square segment, etc., up to a sixteen square segment picture arrangement. The location of a particular square partial picture segment within these picture arrangements can be represented schematically as in FIG. 2*a* and 2*b*.

Each square segment of FIG. 2*a* and 2*b* also indicates in which orientation, rightside up or upside down, the partial picture is to be displayed on that square segment. If the partial picture orientation is to be displayed rightside up and the picture arrangement diagram is to be viewed rightside up, then the boxed symbol is represented in a rightside up orientation as well as being positioned above the picture arrangement diagram for that square segment. If the partial picture orientation is to be displayed in an upside down orientation, then the boxed symbol is represented in an upside down orientation as well as being positioned below the picture arrangement diagram for that square segment.

The quadrant to which the square segment with the upside down partial picture belongs is determined by turning around the square segment so that the picture arrangement diagram is now below a rightside up boxed symbol and in the correct orientation for viewing the picture arrangement diagram. To illustrate, the two schematics of FIG. 2*a* and 2*b* correspond to the two sides of the puzzle shown in FIG. 1*a* and 1*b*, and the square segment in the second column and the first row of FIG. 1*a* shows a partial picture of a ship in an upside down orientation. Correspondingly, FIG. 2*a* schematically presents the information that the square segment in the second column and the first row forms the upper left quadrant of a picture of a ship in an upside down orientation on playing side 2 of the puzzle.

For a viewer to see that the square segment forms the upper left quadrant of a picture of a ship, the segment can be turned around so that the symbol of the ship is viewed in a rightside up orientation as well as being positioned above the picture arrangement diagram. Using another example to illustrate, the square segment in the second column and the third row of FIG. 1*a* depicts a partial picture of a car. The corresponding square segment in FIG. 2*a* schematically presents the information that the square segment in the second column and the third row forms the lower right quadrant of a picture of a car in a rightside up orientation on playing side 1 of the puzzle. The rightside up orientation is determined by the rightside up boxed symbol for the car being positioned above the picture arrangement diagram.

FIGS. 3*a* through 3*f* illustrate the steps involved in folding the puzzle shown in FIG. 1*a*–1*b* and schematically represented in FIG. 2*a*–2*b*. While each square segment of the puzzle is numbered in FIGS. 3*a*–3*f*, the numbers are used solely for purposes of explanation and would not be present on a puzzle. The numbering of the square segments in FIGS. 3*a*–3*f* correspond to the numbering in the schematics FIG. 2*a* and 2*b* with numbers 17–32 designating squares on the opposite side not shown initially in FIGS. 3*a*–3*f*. When a square segment from side 2 is folded so that it appears on the side (side 1) viewed in FIGS. 3*a*–3*f*, that numbered square segment is shown as part of the folding sequence.

Figure 3A:
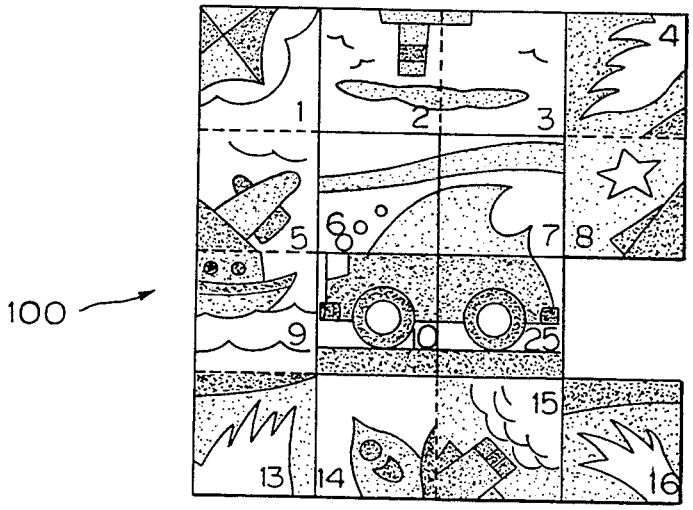
FIG. 3*a*–3*f* show the process of folding a folding picture puzzle to assemble a complete picture.
Figure 3B:
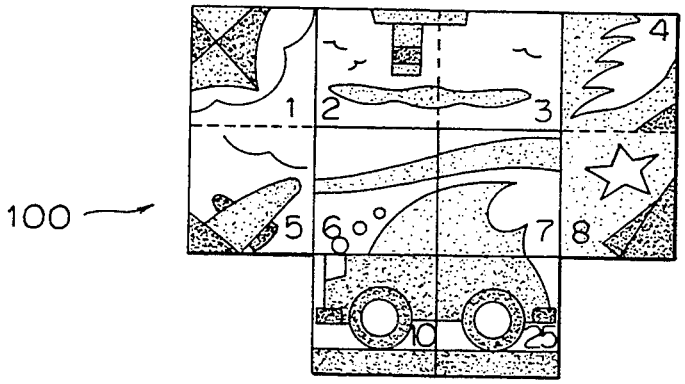

FIG. 3*a* shows the first step in the folding sequence to solve the assembly of a picture of a car. Square segment 25 from side 2 is folded back onto square segment 11 of side 1 to form the bottom half or the lower two quadrants (square segments 10 and 25) of the car picture. FIG. 3*b* combines a series of folds to place squares in the lower half of the puzzle that are extraneous and not relevant to a picture of a car (square segments 9 and 13–16) behind squares 10 and 25. A series of folds to remove extraneous square segments from view can usually be performed in a variety of different sequences. For example, the following sequence of folds are all available for removing squares 15 and 16 from view: (1) square segment 16 may be folded over square segment 15 and then both square segments 15 and 16 together can be folded underneath square 25, or (2) square segment 16 is folded underneath square segment 15 and then both square segment 15 and 16 can be folded underneath square segment 25, or (3) square segments 15 and 16 can be folded together so that square segment 15 is underneath square 25 and square 29 is in view immediately to the right of square 25 and then square 29 is folded underneath square 25.

As can be seen from this example of different series of folds achieving the same result, it should be noted that while there is only one unique solution to solving each picture in the puzzle, the sequence of folds used in the solution may vary. A further series of folds are required to arrive at the folding or picture assembly stage shown in FIG. 3*b*. One possibility is to fold square segments 13 and 14 underneath square segments 9 and 10 and then fold square segment 9 underneath square segment 10. Again, there are other variations in the series of folds for achieving the result shown in FIG. 3*b*.

Figure 3C:
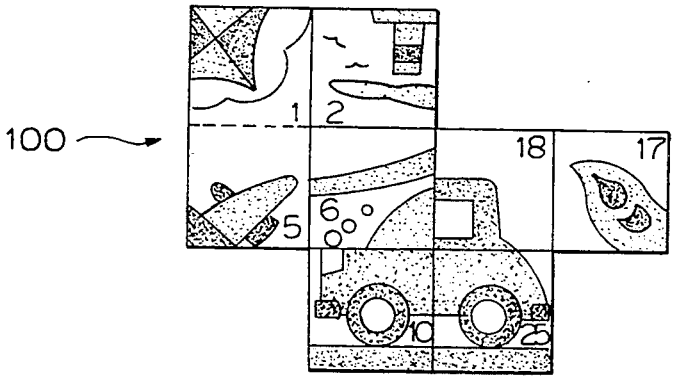
Figure 3D:
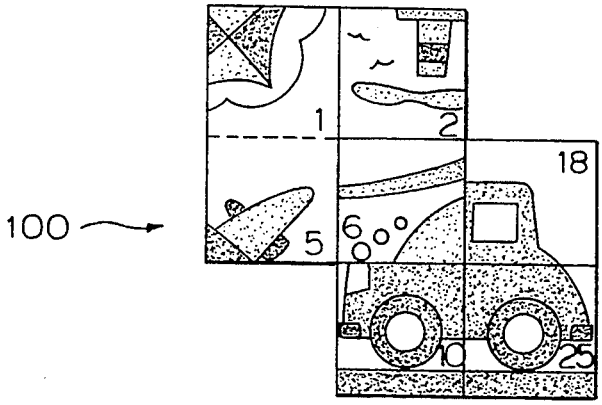
Figure 3E:
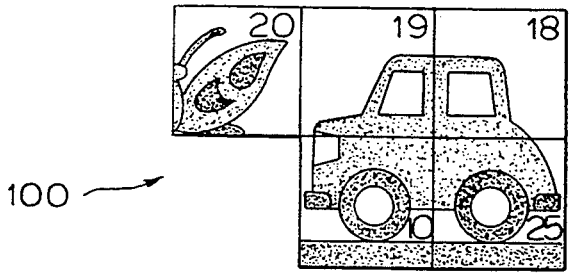
Figure 3F:
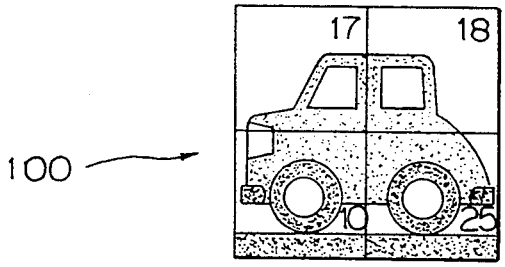

Next, square segments 3 and 4 together are folded down over square segments 7 and 8 to arrive at the folding stage depicted in FIG. 3*c*. At this point, squares 10, 18 and 25 form three quadrants of the four quadrant picture image of a car. The folding stage of FIG. 3*d* is simply achieved from FIG. 3*c* by folding square segment 17 underneath square segment 18. After square segments 1 and 2 are folded over square segments 5 and 6 to arrive at the folding stage represented in FIG. 3*e*, a complete four quadrant picture of a car is assembled, albeit with an extraneous square segment still showing.

It is common in the process of solving a folding picture puzzle of the present invention that while a complete and assembled picture is formed, extraneous square segments still remain that need to be folded underneath the assembled picture to achieve the final assembled picture solution. In the folding sequence for solving the picture of a car, the final step of folding the extraneous square segment 20 underneath square segment 19 produces the final solution (FIG. 3*f*) where only square segments 19, 18, 10 and 25 which form the four quadrants of the picture is in view.

The schematic diagram of the puzzle shown in FIGS. 3*a*–3*f* is displayed in FIGS. 2*a* and 2*b*. As an example of how to correlate the schematic diagram with the puzzle shown in FIGS. 1*a*–1*b* and 3*a*–3*f*, it can be seen from FIGS. 2*a* and 2*b* that (a) when the square segment 10 located in the second column and third row of side 1 displays a rightside up partial picture of a car belonging to the lower left quadrant of the assembled picture, (b) when the square segment 25 located in the first column and third row of side 2 displays a rightside up partial picture of a car belonging to the lower right quadrant of the assembled picture, (c) when the square segment 18 located in the second column and first row of side 2 displays an upside down partial picture of a car belonging to the upper right quadrant of the assembled picture, and (d) when the square segment 19 located in the third column and first row of side 2 displays an upside down partial picture of a car belonging to the upper left quadrant of the assembled picture, the assembled picture of a car can be completed by following the folding sequence described in FIGS. 3*a*–3*f*.

It should be understood that any picture or image can be subdivided in the same manner as for the picture of the car and consequently, can also be solved in the same manner. In designing the puzzle, the quadrant square picture segments are positioned in their specific square segment locations in the proper orientation so as to be re-united as a complete assembled picture when folded and aligned properly. Pictures or images can be subdivided into four square partial picture segments (quadrants) or they can be subdivided into any even number of square partial picture segments between two and sixteen. Furthermore, pictures or images are preferably of objects or scenes easily recognizable to the player of the puzzle. The pictures or images represented by boxed picture symbols (FIGS. 2*a*–2*b*, 4*a*–4*b*, 5*a*–5*b*, 6*a*–6*b*, and 7*a*–7*b*) or boxed letters (FIGS. 8*a* and 8*b*) can be interchanged with a countless variety of pictures and images that are easily recognizable.

Figure 4A:
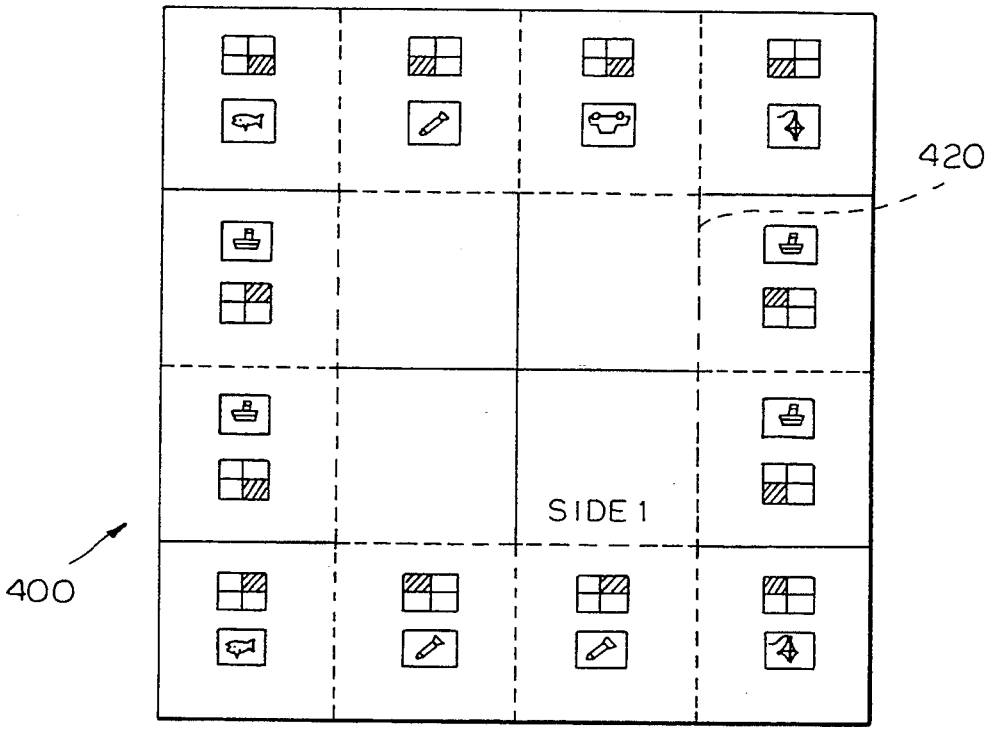
FIG. 4*a* shows one face/side of a second embodiment of the folding picture puzzle in schematic/explanatory form.
Figure 4B:
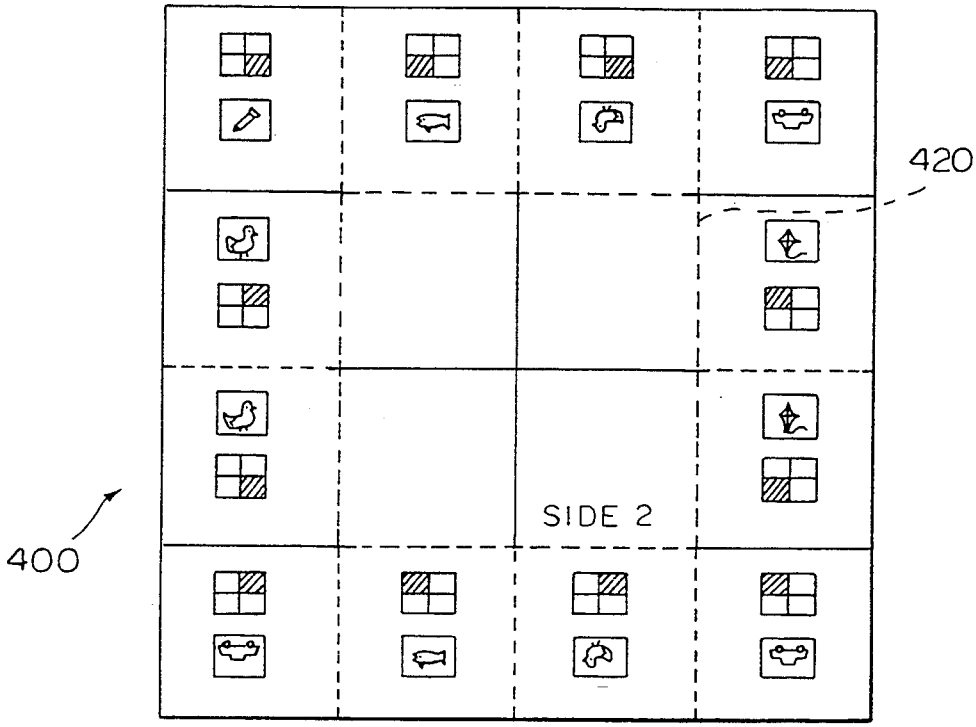
FIG. 4*b* shows the opposite face/side of the second embodiment of the folding picture puzzle in schematic-/explanatory form.

Schematic representations for each embodiment, e.g. FIGS. 2*a*–2*b*, are provided to show how square picture segments are positioned and how they interrelate to form complete pictures. A second embodiment is schematically represented in FIGS. 4*a* and 4*b*. This embodiment is a sixteen square puzzle 400 in a four square by four square rectangular format containing six separate pictures (represented by boxed picture symbols), each of which is formed by aligning four square partial picture segments or quadrants in proper juxtaposition. As in FIGS. 2*a*–2*b*, solid lines between adjacent square segments are hinge or score lines and dashed lines between adjacent square segments are cuts.

This embodiment differs from that of FIGS. 1–3 in that there is a four square center stage area that is blank on both playing sides of the puzzle. The stage area for assembling and presenting the completed picture may be located in the center of the puzzle or may be located elsewhere, and also has the same dimension as the completed picture, ie. any even number between two and sixteen. The stage area may be blank (not provided with partial pictures) or it may be provided with square segments displaying partial pictures. In addition, the stage area may be delimited by an indicator band or color 420 as shown in FIGS. 4*a* and 4*b*.

Figure 5A:
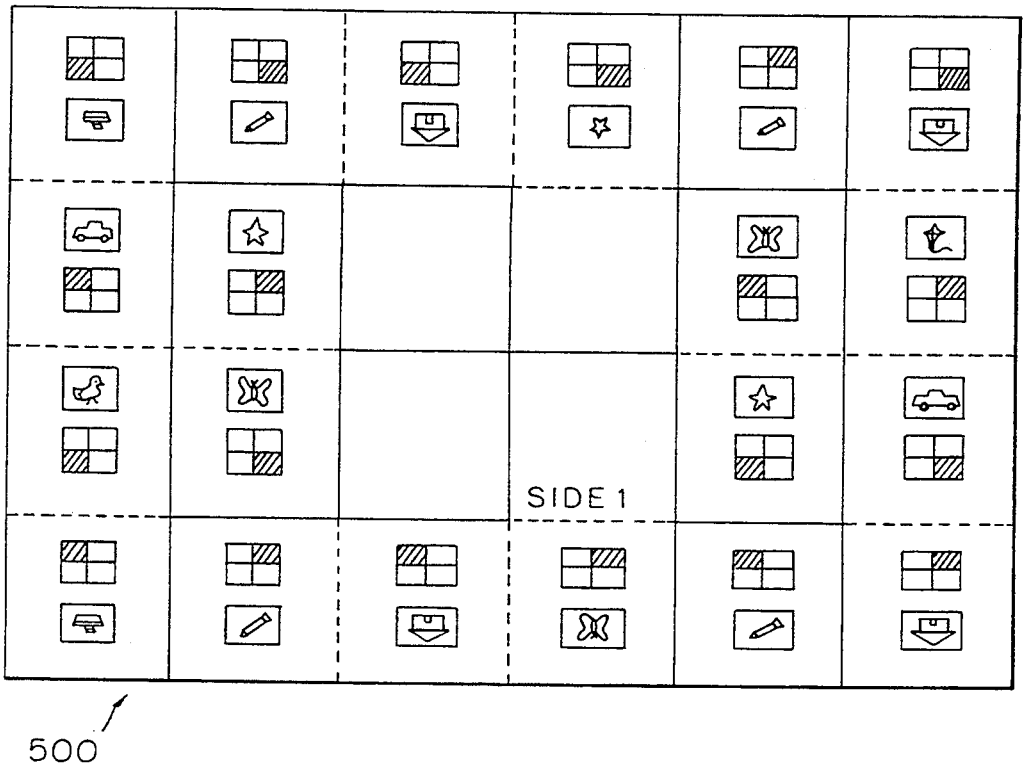
FIG. 5*a* shows one face/side of a third embodiment of the folding picture puzzle in schematic/explanatory form.
Figure 5B:
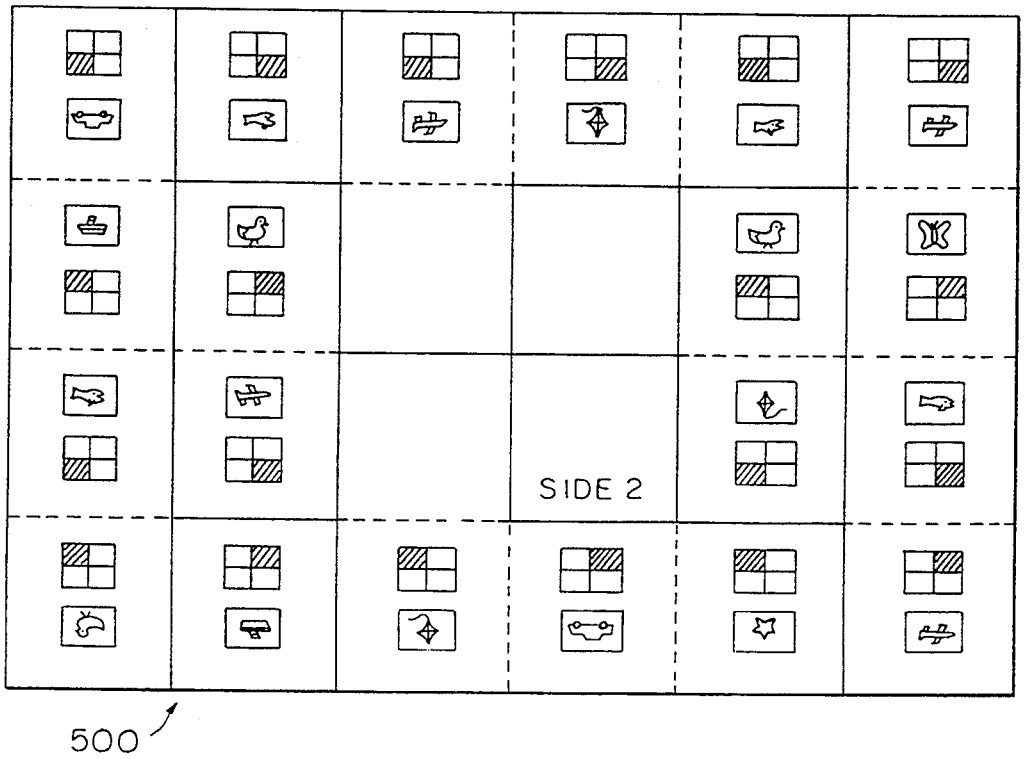
FIG. 5*b* shows the opposite face/side of the third embodiment of the folding picture puzzle in schematic-/explanatory form.

A third embodiment of the invention is schematically represented in FIGS. 5*a* and 5*b* as a 24-square puzzle 500 in a six square by four square rectangular format having ten separate pictures, each of which is formed by aligning four square partial picture segments in proper juxtaposition on a blank four square center stage.

Figure 6A:
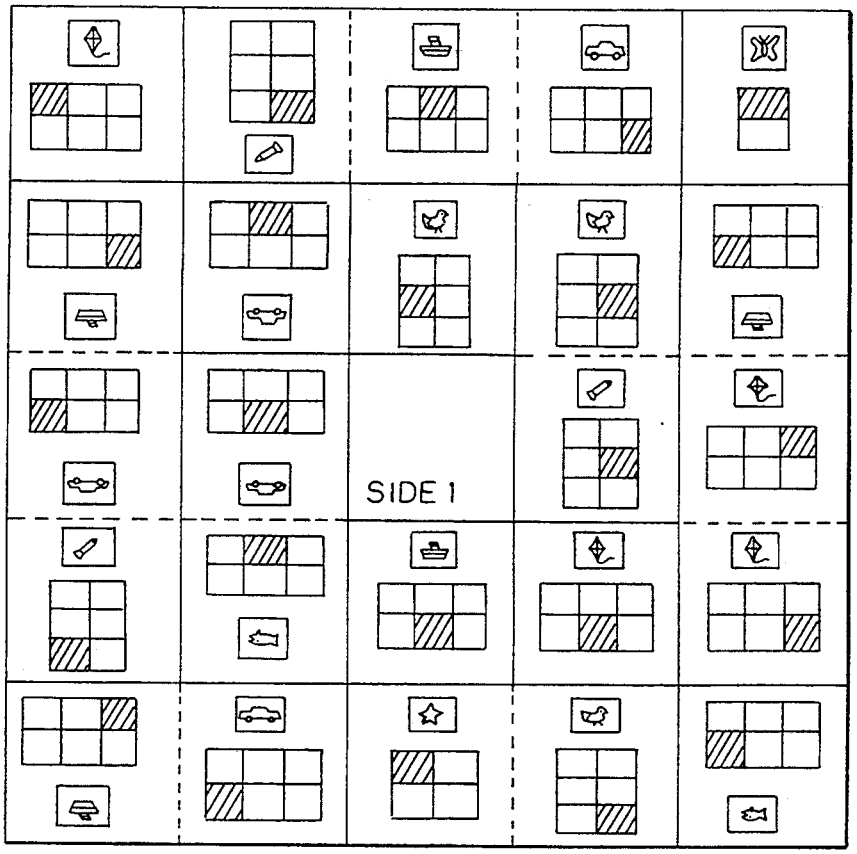
FIG. 6*a* shows one face/side of a fourth embodiment of the folding picture puzzle in schematic/explanatory form.
Figure 6B:
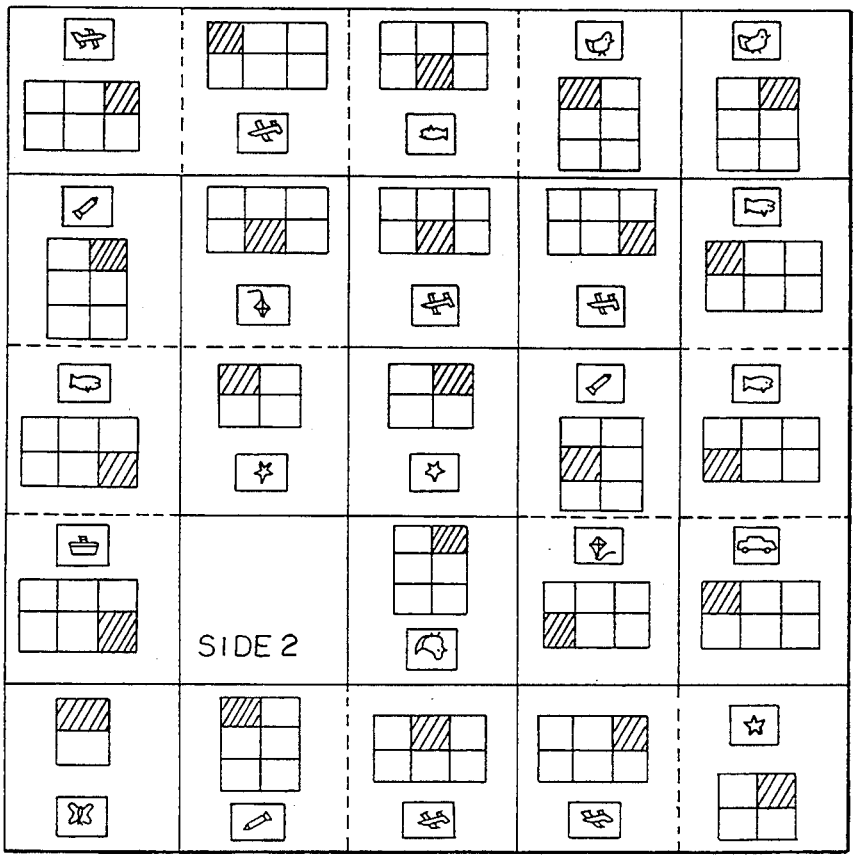
FIG. 6*b* shows the opposite face/side of a fourth embodiment of the folding picture puzzle in schematic-/explanatory form.

The fourth embodiment of the invention is schematically represented in FIGS. 6*a* and 6*b* as a 25-square puzzle 600 in a five square by five square format containing nine separate pictures (eight pictures on side 1 and one picture on side 2), each of which is formed by aligning either two, four or six square partial picture segments in proper juxtaposition on a variable stage. On each playing side, there is a single square segment not provided with a partial picture.

Figure 7A:
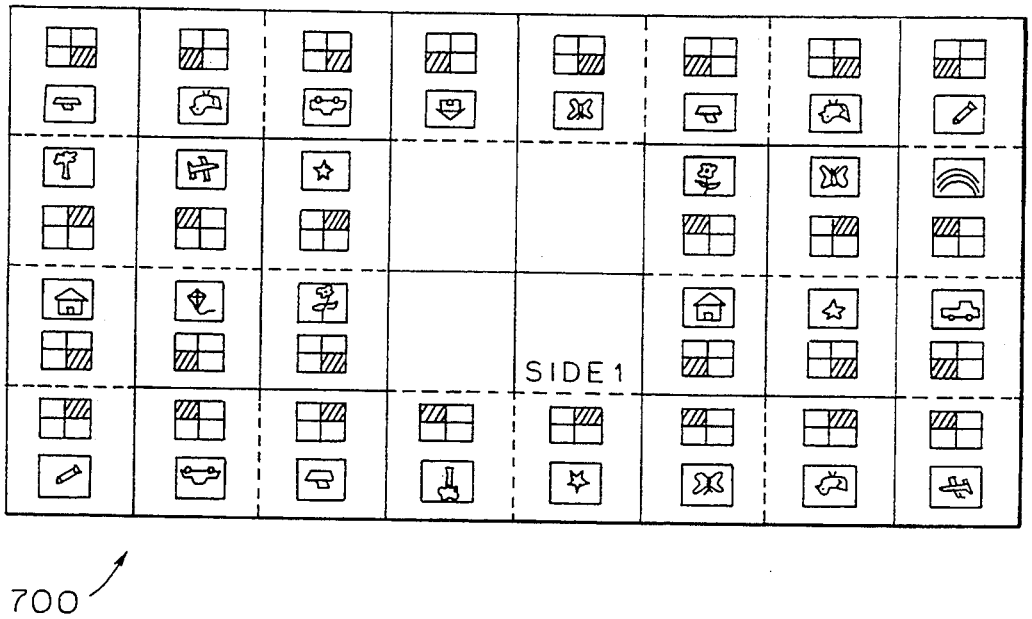
FIG. 7*a* shows one face/side of a fifth embodiment of the folding picture puzzle in schematic/explanatory form.
Figure 7B:
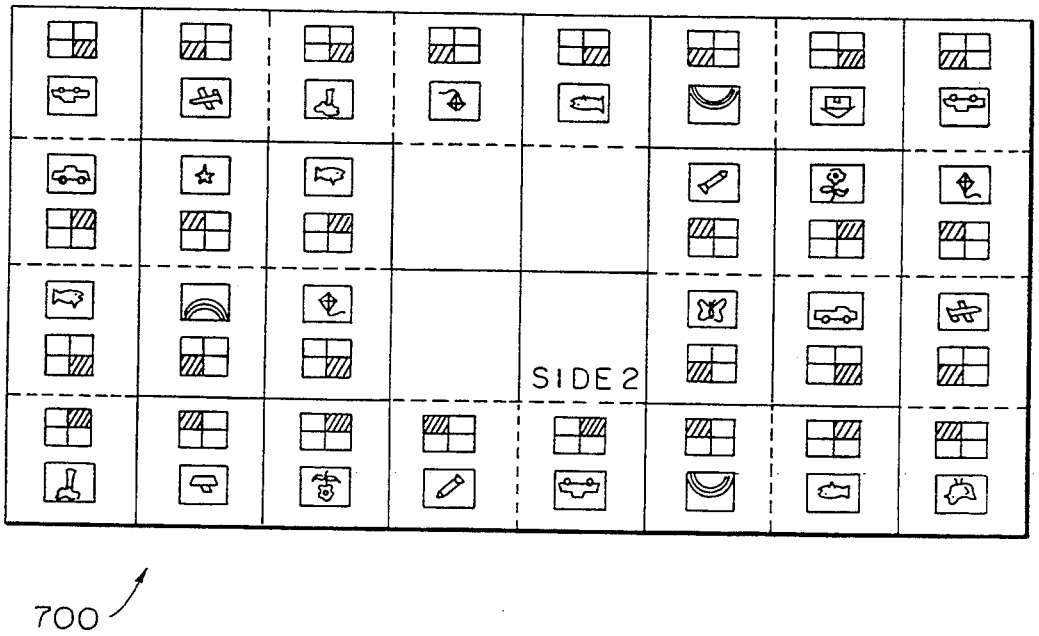
FIG. 7*b* shows the opposite face/side of the fifth embodiment of the folding picture puzzle in schematic-/explanatory form.

The fifth embodiment of the invention, schematically represented in FIGS. 7*a* and 7*b*, is a 32-square puzzle 700 in an eight square by four square format containing fourteen separate pictures (eight pictures on side 1 and six pictures on side 2), each of which is formed by aligning four square partial picture segments in proper juxtaposition on a blank four square center stage area.

Figure 8A:
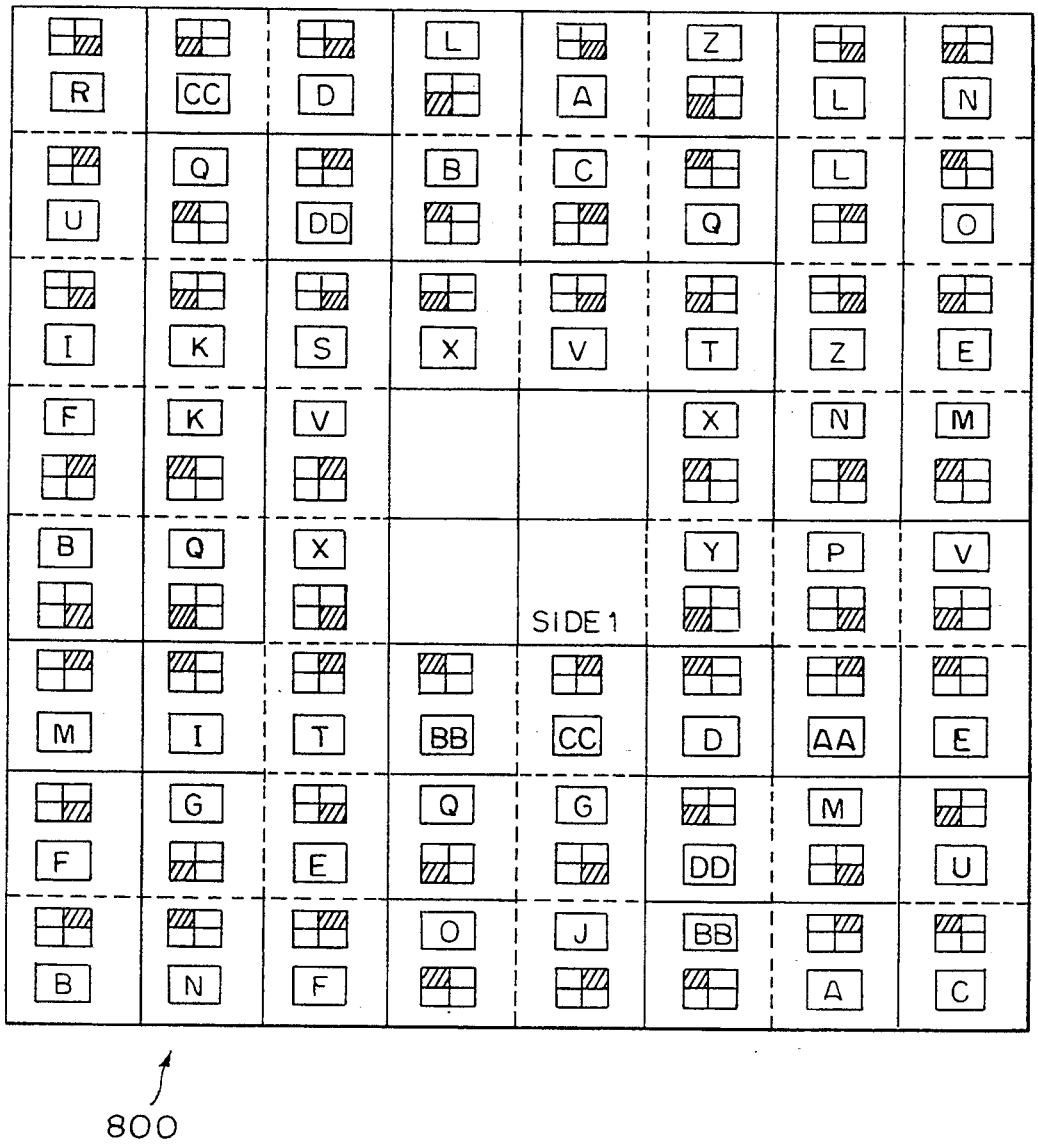
FIG. 8*a* shows one face/side of a sixth embodiment of the folding picture puzzle in schematic/explanatory form.
Figure 8B:
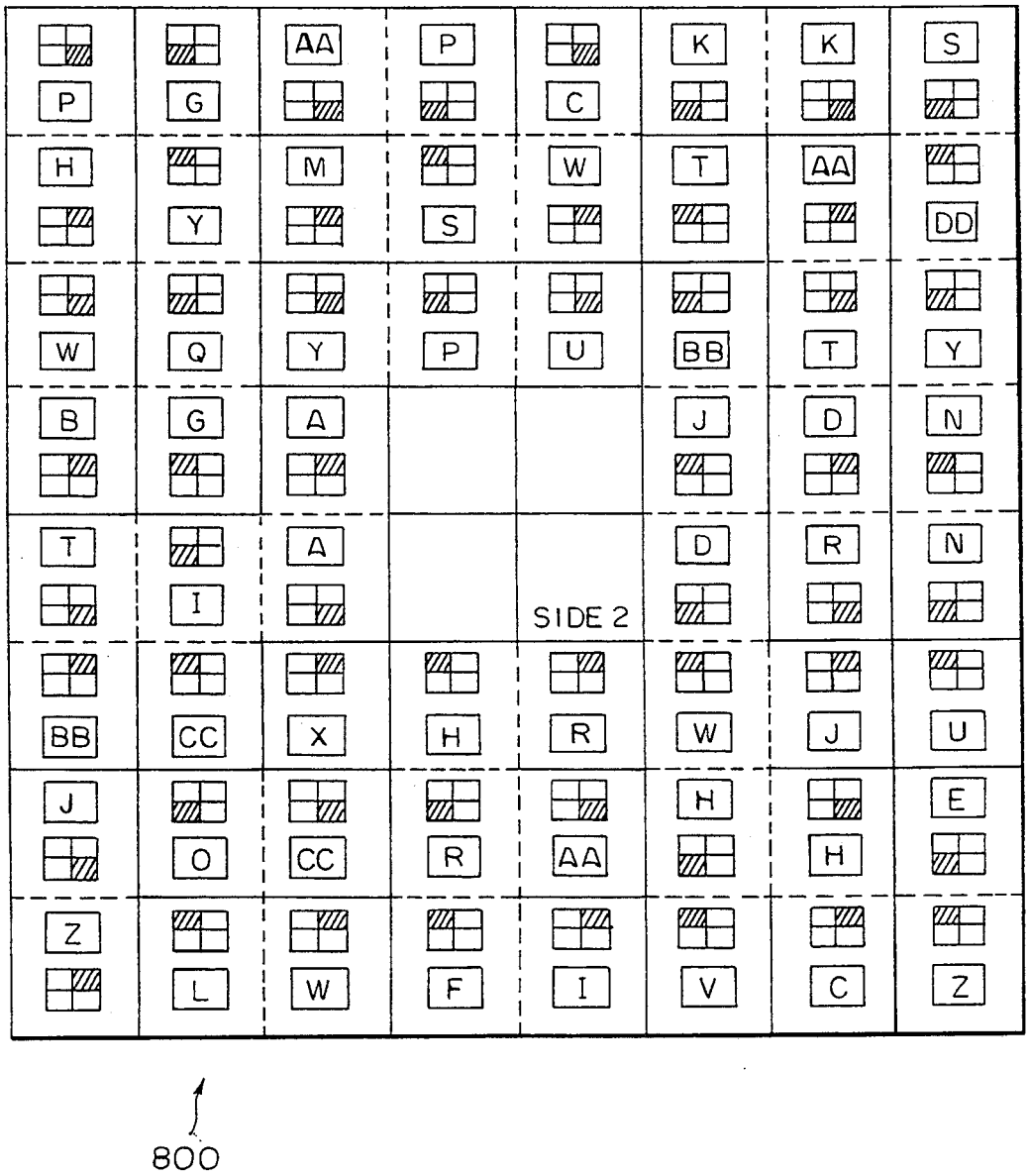
FIG. 8*b* shows the opposite face/side of the sixth embodiment of the folding picture puzzle in schematic-/explanatory form.

The sixth embodiment of the invention, schematically represented in FIGS. 8*a* and 8*b*, is a 64-square puzzle 800 in an eight square by eight square format containing 30 separate pictures, each of which is formed by aligning four square partial picture segments in proper juxtaposition on a blank four square center stage area. Individual pictures are distinguishable by the use of boxed letter(s) instead of boxed picture symbols for the sake of reducing the number of picture symbols needed to represent all 30 separate pictures. However, there is a difference in determining partial picture orientation for this schematic. When the boxed letter(s) is above the picture arrangement diagram, the picture arrangement diagram is to be viewed rightside up. When the boxed letter(s) is below the picture arrangement diagram, the picture arrangement diagram is upside down and needs to be turned over for proper viewing and ease of determining picture arrangement.

Figure 9A:
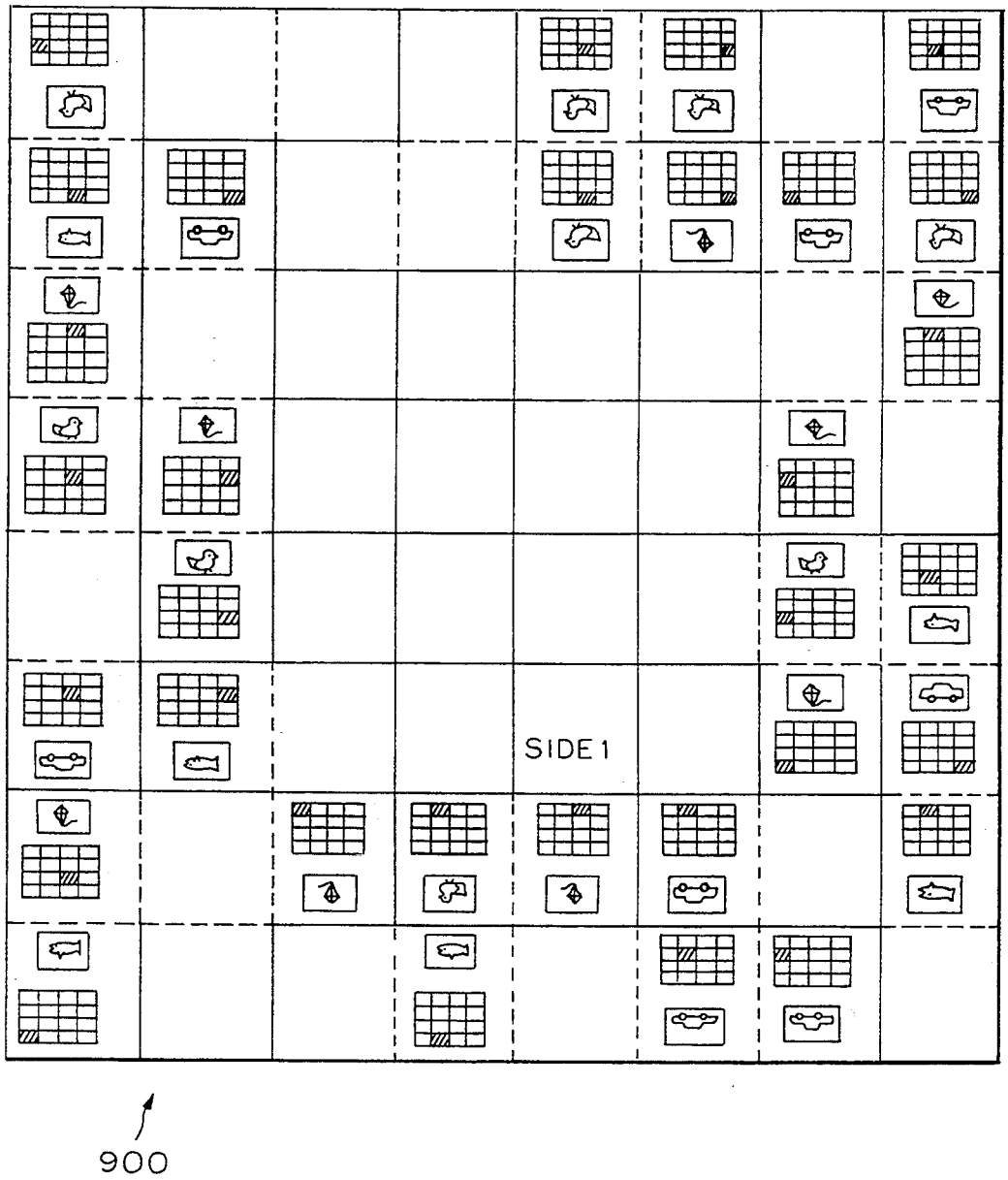
FIG. 9*a* shows one face/side of a seventh embodiment of the folding picture puzzle in schematic/explanatory form.
Figure 9B:
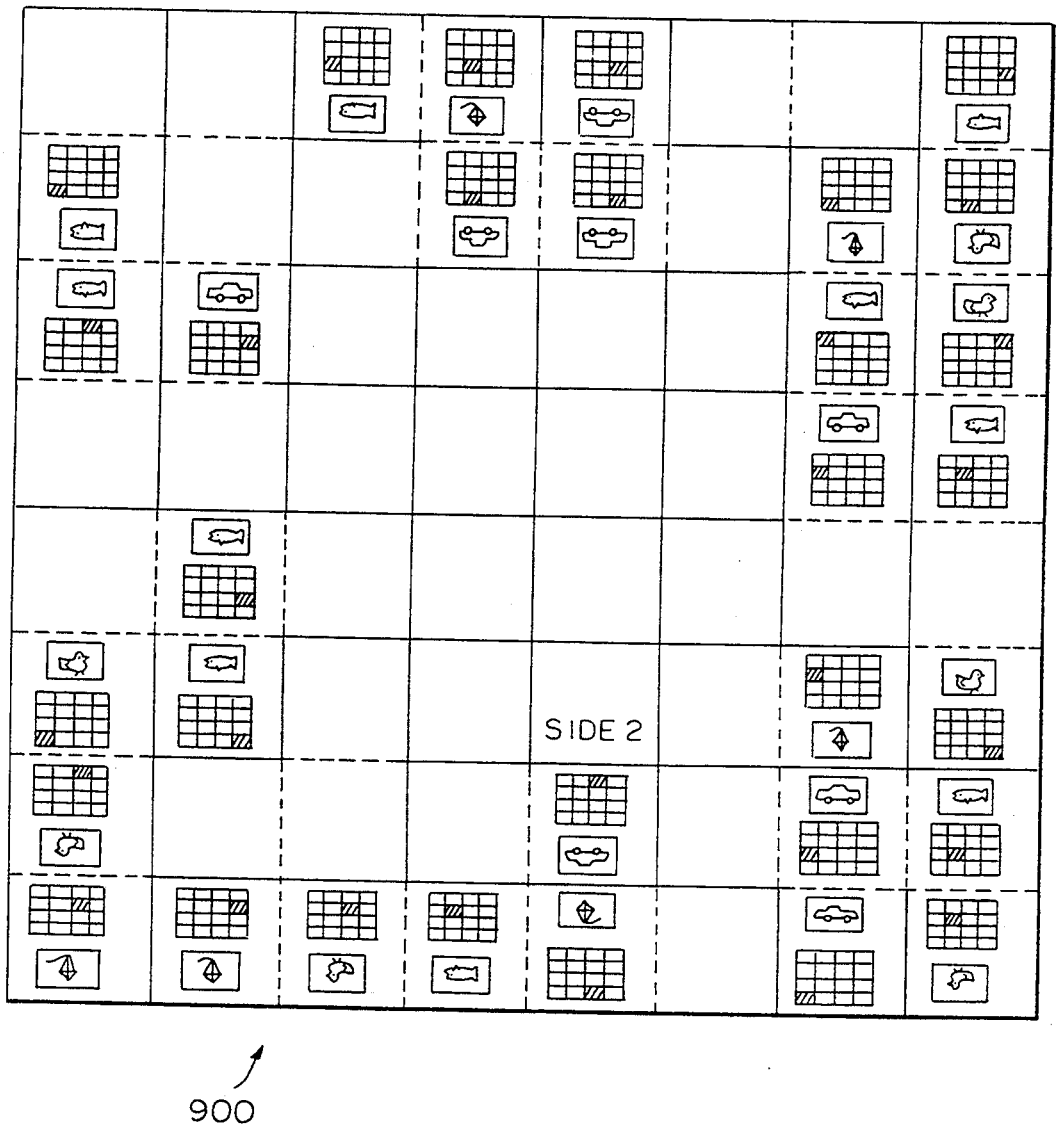
FIG. 9*b* shows the opposite face/side of the seventh embodiment of the folding picture puzzle in schematic-/explanatory form.

The seventh embodiment of the invention, schematically represented in FIGS. 9*a* and 9*b*, is a 64-square puzzle 900 containing four separate pictures (two on each playing side), each of which is formed by aligning sixteen square partial picture segments in proper juxtaposition on a blank sixteen square center stage area. As shown in FIGS. 9*a* and 9*b*, there are additional squares outside the center stage area that are not provided with a partial picture.

While the embodiments of the invention are shown as being in 16-square, 24-square, 25-square, 32-square and 64 square puzzle formats, other puzzle formats having a format with twelve and 49 squares or an even number between 16 and 64 have been contemplated, in particular, formats of 20, 28, 30, 36, 40, 42, 44, 48, 50, 52, 54, 56 and 60 squares.

Some embodiments of the invention may have complete assembled picture images that are outlined with additional indicia such as a bold line, forming a design in the nature of a picture frame.

Printed pictures or hints of what the final individual assembled pictures look like can be supplied to assist the player in the folding process. However, despite such assistance, the player must still discover the solution by trial and error as well as by insight.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A folding picture puzzle comprising:

a rectangular base sheet having two playing sides, at least one of said playing sides being provided with indicia, said base sheet being completely divided into at least sixteen squares of equal and uniform size by a combination of horizontally and vertically oriented hinge lines and cuts, said squares being held together as a contiguous piece by said hinge lines with said hinge lines joining at least one side of each square to an adjacent square, at least some of said hinge lines being oriented vertically and at least some of said hinge lines being capable of hinging in both directions, said cuts, at least some beginning at an edge of said base sheet and extending a distance measured as a discrete multiple of square length toward an opposite edge of said base sheet, completely separating adjacent squares and facilitating bi-directional folding of said squares along said hinge lines whereby two or more of said squares provided with indicia cooperate to form an assembled image on one of said playing sides, at least some of said cuts being oriented horizontally, said squares cooperating in combinations to form one or more assembled images on at least one of said playing sides.

2. A folding picture puzzle as recited in claim 1, wherein all of said squares are provided with indicia.

3. A folding picture puzzle as recited in claim 1, wherein said base sheet further comprises a stage within its perimeter having a rectangular boundary into which all squares are folded to form said assembled images.

4. A folding picture puzzle as recited in claim 3, wherein said stage is a blank stage.

5. A folding picture puzzle as recited in claim 3, wherein said stage is formed in a rectangular format from an even number between two and sixteen of said squares.

6. A folding picture puzzle as recited in claim 3, wherein said stage is delimited by an indicator band of color.

7. A folding picture puzzle as recited in claim 1, wherein said squares cooperate to form separately on both of said playing sides a total of between 6 and 30 assembled images.

8. A folding picture puzzle as recited in claim 1, wherein said squares cooperate to form separately on at least one playing side a total of between 3 and 15 assembled images.

9. A folding picture puzzle as recited in claim 1, wherein said base sheet is divided into a number of equal and uniform squares, said number being and selected from the group consisting of 12, 16, 20, 24, 25, 28, 30, 32, 36, 40, 42, 44, 48, 49, 50, 52, 54, 56, 60 and 64.

10. A folding picture puzzle as recited in claim 9, wherein:

said base sheet is divided into sixteen squares of equal and uniform size, forming four vertical columns and four horizontal rows, by a combination of said horizontally and vertically oriented hinge lines and cuts so as to define from left to right, first, second, third and fourth columns and from top to bottom, first, second, third and fourth rows;

said cuts completely separating adjacent squares and being disposed:

between the second and third columns in the first and fourth rows;

between the first and second rows in the first and fourth columns;

between the second and third rows in the first and fourth columns; and between the third and fourth rows in the first and fourth columns; and said squares are all provided with indicia and cooperate to form separately on said playing sides a total of eight assembled images.

11. A folding picture puzzle as recited in claim 9, wherein:

said base sheet is divided into sixteen squares of equal and uniform size, forming four vertical columns and four horizontal rows, by a combination of said horizontally and vertically oriented hinge lines and cuts so as to define from left to right, first, second, third and fourth columns and from top to bottom, first, second, third and fourth rows;

said cuts completely separating adjacent squares and being disposed:

between the first and second columns in the first and fourth rows;

between the second and third columns in the first and fourth rows;

between the third and fourth columns in the first and fourth rows; and between the second and third rows in the first and fourth columns;

said squares cooperate to form separately on said playing sides a total of six assembled images; and said base sheet further comprising a blank stage, disposed between the first and fourth columns and between the first and fourth rows, into which all squares are folded to form said assembled images.

12. A folding picture puzzle as recited in claim 9, wherein said base sheet is divided into 24 squares of equal and uniform size, forming six vertical columns and four horizontal rows, by a combination of said horizontally and vertically oriented hinge lines and cuts so as to define from left to right, first, second, third, fourth, fifth and sixth columns and from top to bottom, first, second, third and fourth rows;

said cuts completely separating adjacent squares and being disposed, when viewed on one of said playing sides:

between the second and third columns in the first and fourth rows;

between the third and fourth columns in the first and fourth rows;

between the first and second rows in the first, fourth and sixth column;

between the second and third rows in the first, second, fifth and sixth columns; and between the third and fourth rows in the first, fourth and sixth columns;

said squares cooperate to form separately on said playing sides a total of ten assembled images; and said base sheet further comprising a blank stage, disposed between the second and fifth columns and between the first and fourth rows, into which all squares are folded to form said assembled images.

13. A folding picture puzzle as recited in claim 9, wherein:

said base sheet is divided into 25 squares of equal and uniform size, forming five vertical columns and five horizontal rows, by a combination of said horizontally and vertically oriented hinge lines and cuts so as to define from left to right, first, second, third, fourth and fifth columns and from top to bottom, first, second, third, fourth and fifth rows;

said cuts completely separating adjacent squares and being disposed, when viewed on one of said playing sides:

between the first and second columns in the fifth row;

between the second and third columns in the first row;

between the third and fourth columns in the first and fifth rows;

between the fourth and fifth columns in the first row;

between the second and third rows in the first, fourth and fifth columns; and between the third and fourth rows in the first, second and fifth columns; and said squares cooperate to form separately on said playing sides of a total of nine assembled images.

14. A folding picture puzzle as recited in claim 9, wherein:

said base sheet is divided into 32 squares of equal and uniform size, forming eight vertical columns and four horizontal rows, by a combination of said horizontally and vertically oriented hinge lines and cuts so as to define from left to right, first, second, third, fourth, fifth, sixth, seventh and eighth columns and from top to bottom, first, second, third and fourth rows;

said cuts completely separating adjacent squares and being disposed, when viewed on one of said playing sides:

between the second and third columns in the first and fourth rows;

between the fourth and fifth columns in the fourth row;

between the fifth and sixth columns in the first row;

between the sixth and seventh columns in the first and fourth rows;

between the first and second rows in the first, fourth, fifth and eighth columns;

between the second and third rows in the first, second, third, sixth, seventh and eighth columns; and between the third and fourth rows in the first, fourth, fifth and eighth columns;

said squares cooperate to form separately on said playing sides a total of fourteen assembled images; and said base sheet further comprising a blank stage, disposed between the third and sixth columns and between the first and fourth rows, into which all squares are folded to form said assembled images.

15. A folding picture puzzle as recited in claim 9, wherein said base sheet is divided into 64 squares of equal and uniform size, forming eight vertical columns and eight horizontal rows, by a combination of said horizontally and vertically oriented hinge lines and cuts so as to define from left to right, first, second, third, fourth, fifth, sixth, seventh and eighth columns and from top to bottom, first, second, third, fourth, fifth, sixth, seventh and eighth rows;

said cuts completely separating adjacent squares and being disposed, when viewed on one of said playing sides:

between the second and third columns in the first, sixth and seventh rows;

between the fourth and fifth columns in the second, third, sixth, seventh and eighth rows;

between the fifth and sixth columns in the first, second, third and fifth rows;

between the sixth and seventh columns in the fifth, seventh and eighth rows;

between the seventh and eighth columns in the fifth row;

between the first and second rows in the first, fourth, fifth, seventh and eighth columns;

between the second and third rows in the first, second, seventh and eighth columns;

between the third and fourth rows in the first, second, third, seventh and eighth columns;

between the fourth and fifth rows in the first, second, third and sixth columns;

between the fifth and sixth rows in the third, seventh and eighth columns;

between the sixth and seventh rows in the third and fifth columns; and between the seventh and eighth rows in the first, second, third, fifth and eighth columns;

said squares cooperate to form separately on said playing sides a total of thirty assembled images; and said base sheet further comprising a blank stage, disposed between the third and sixth columns and between the third and sixth rows, into which all squares are folded to form said assembled images.

16. A folding picture puzzle as recited in claim 9, wherein:

said base sheet is divided into 64 squares of equal and uniform size, forming eight vertical columns and eight horizontal rows, by a combination of said horizontally and vertically oriented score lines and cuts so as to define from left to right, first, second, third, fourth, fifth, sixth, seventh and eighth columns and from top to bottom, first, second, third, fourth, fifth, sixth, seventh and eighth rows;

said cuts completely separating adjacent squares and being disposed:

between the first and second columns in the seventh row;

between the second and third columns in the first, sixth and seventh rows;

between the third and fourth columns in the second and eighth rows;

between the fourth and fifth columns in the second, seventh and eighth rows;

between the fifth and sixth columns in the first, second and eighth rows;

between the sixth and seventh columns in the fifth, seventh and eighth rows;

between the seventh and eighth columns in the fifth row;

between the first and second rows in the first, fourth, fifth, seventh and eighth columns;

between the second and third rows in the first, second, seventh and eighth columns;

between the third and fourth rows in the first, second, seventh, and eighth columns;

between the fourth and fifth rows in the first and second columns;

between the fifth and sixth rows in the first, seventh and eighth columns;

between the sixth and seventh rows in the eighth column; and between the seventh and eighth rows in the first, second and eighth columns;

said squares cooperate to form separately on said playing sides a total of four assembled images; and said base further comprising a blank stage, disposed between the second and seventh columns and between the second and seventh rows, into which all squares are folded to form said assembled images.

17. A folding picture puzzle as recited in claim 1, wherein said assembled images are each provided with additional indicia along its border to act as a picture frame.

18. A folding picture puzzle as recited in claim 1 wherein said base sheet comprises two rectangular sheets of clear plastic film sandwiching a paper base sheet to form a laminate.

19. A folding picture puzzle as recited in claim 17, wherein said plastic film is polyethylene terephthalate.

20. A folding picture puzzle as recited in claim 1, wherein said base sheet comprises a plastic material.

21. A folding picture puzzle as recited in claim 20, wherein said plastic material comprises a vinyl plastic.

22. A folding picture puzzle as recited in claim 20, wherein said plastic material is clear.

23. A folding picture puzzle as recited in claim 1, wherein said folding puzzle folds flat to a sufficiently small size for storage.

24. A folding picture puzzle as recited in claim 1, wherein said cuts are die cuts.

25. A folding picture puzzle as recited in claim 1, wherein said squares cooperate to form one or more assembled images on both of said two playing sides.

* * * * *